US009373452B2

(12) United States Patent
Warwick et al.

(10) Patent No.: US 9,373,452 B2
(45) Date of Patent: Jun. 21, 2016

(54) TUNED, INTERCHANGABLE SHUTTLE BOARD RELAY

(71) Applicants: Thomas P. Warwick, Melbourne, FL (US); James V. Russell, New Hope, PA (US)

(72) Inventors: Thomas P. Warwick, Melbourne, FL (US); James V. Russell, New Hope, PA (US)

(73) Assignee: R&D Circuits, Inc., South Planfield, NJ (US)

( * ) Notice: Subject to any disclaimer, the term of this patent is extended or adjusted under 35 U.S.C. 154(b) by 192 days.

(21) Appl. No.: 14/048,246

(22) Filed: Oct. 8, 2013

(65) Prior Publication Data

US 2015/0096873 A1 Apr. 9, 2015

(51) Int. Cl.

| | |
|---|---|
| ***H01H 45/02*** | (2006.01) |
| ***H01H 1/36*** | (2006.01) |
| ***H01H 1/40*** | (2006.01) |
| *H01H 1/00* | (2006.01) |

(52) U.S. Cl.

CPC ..... *H01H 1/403* (2013.01); *H01H 1/365* (2013.01); *H01H 45/02* (2013.01); *H01H 1/0036* (2013.01)

(58) Field of Classification Search

CPC ..... H01H 2221/014; H01H 45/02

USPC ..... 333/101, 105, 262; 335/75, 106, 107, 335/147, 167; 200/181

See application file for complete search history.

(56) References Cited

U.S. PATENT DOCUMENTS

| | | | | |
|---|---|---|---|---|
| 5,121,089 | A * | 6/1992 | Larson | H01H 1/0036 200/181 |
| 6,072,686 | A * | 6/2000 | Yarbrough | H01P 1/127 200/181 |
| 6,218,911 | B1 * | 4/2001 | Kong | H01H 59/0009 200/181 |
| 6,587,021 | B1 * | 7/2003 | Streeter | H01H 1/0036 200/181 |
| 8,022,794 | B2 * | 9/2011 | Nakatsuka et al. | 333/262 |
| 2007/0236307 | A1 * | 10/2007 | Liu | H01H 59/0009 333/105 |
| 2008/0060188 | A1 * | 3/2008 | Ning | H01H 59/0009 29/611 |

* cited by examiner

*Primary Examiner* — Dean Takaoka
*Assistant Examiner* — Alan Wong
(74) *Attorney, Agent, or Firm* — Richard B. Klar, Esq.; Law Office Richard B. Klar

(57) ABSTRACT

A shuttle board relay is provided that is scalable to a specific pitch or routing density. The shuttle board relay provides a path with different sets of electrical components that allows this via by allowing the integration of components and other types of customization. The shuttle board relay provides a minimally disruptive path to the signal. This minimizes loss and signal distortion, isolation and crosstalk are a function of pitch. Since pitch can be set, grounds included, etc., a design may be fully optimized for low cross talk.

37 Claims, 6 Drawing Sheets

TUNED, INTERCHANGABLE SHUTTLE BOARD RELAY

BACKGROUND

1. Field

The present invention relates to a tuned interchangeable shuttle board relay. In particular the present invention provides for a tuned interchangeable shuttle relay that simultaneously redirects current flow for multiple signals in a circuit path that transmits either high data rate digitally encoded data or RF/microwave signals.

2. The Related Art

High Fidelity redirection is a problem associated with electronic devices. Frequently, it is necessary for a transmitter of electronically encoded information to have a signal path for individually connecting to a wide variety of different receivers where the individual connection means that the transmission is neither simultaneous nor connected in a ganged manner. Switches and relays, e.g. electronically controlled switches, are typically employed for redirection. As a result of use of signal redirection relay a number of critical electrical measures result including: loss of signal power (either through dissipative loss or reflective loss), repeatability of loss parameters over the lifetime of the redirection relay, low distortion of the signal, and isolation/crosstalk (how much power escapes and bleeds into adjacent signal paths). The critical mechanical measures are the lifetime of the device, physical size, and reparability.

There are three standard prior art techniques for ultra-high performance relays currently being used. The first technique is to employ large coaxial relays. These relays offer an extremely high performance but the physical size is a minimum of 4 sq inches. The second technique utilizes micro-machined switch relays, where the relay alone is as small as 2 mm×3 mm. These devices are very new to the market place and are a miniaturization of established technologies. While they offer performance benefits over previous generation relays, they are still limited in bandwidth. The third technique involves the use of active transistor-based circuitry. This technique offers size and lifetime benefits but results in power loss. Moreover, since the circuit is made from active transistors, it will add a level of distortion, which is usually unacceptable for performance considerations.

None of the aforementioned three prior art methods allow for any level of customization. The coaxial relay requires physical coaxial connectors for its interface. Field servicing requires relay replacement. The micro-machined switch relay must be physically soldered to a board. Field servicing requires desoldering, with no serviceable mechanisms. Neither relay allows for direct integration into the pc board.

SUMMARY

The present invention provides a shuttle board relay that solves a classic problem in the electronics industry. In a variety of applications, it is necessary to redirect the flow of the signal from one signal receiver to another. For high frequency applications, there are multiple primary problems. The first is physical size, The shuttle board relay of the present invention solves this problem by being scalable to a specific pitch or routing density. The second is that very often the paths require different sets of electrical components. Again the present invention provides a path that allows this via by allowing the integration of components and other types of customization. The third, and often the most critical, is power loss. The unique feature of the present invention provides a shuttle board relay that provides a minimally disruptive path to the signal. This minimizes loss and signal distortion. Isolation and crosstalk are a function of pitch. Because pitch can be set, grounds included, etc., a design may be fully optimized for low cross talk.

The repairable nature of the shuttle board relay of the present invention makes it an excellent candidate for applications, such as test, where a high utilization, low loss device is required. The benefit over other mechanical solutions is that the shuttle board relay does not requite desoldering to repair/replace.

DETAILED DESCRIPTION OF THE PREFERRED EMBODIMENT(S)

Figure 1:
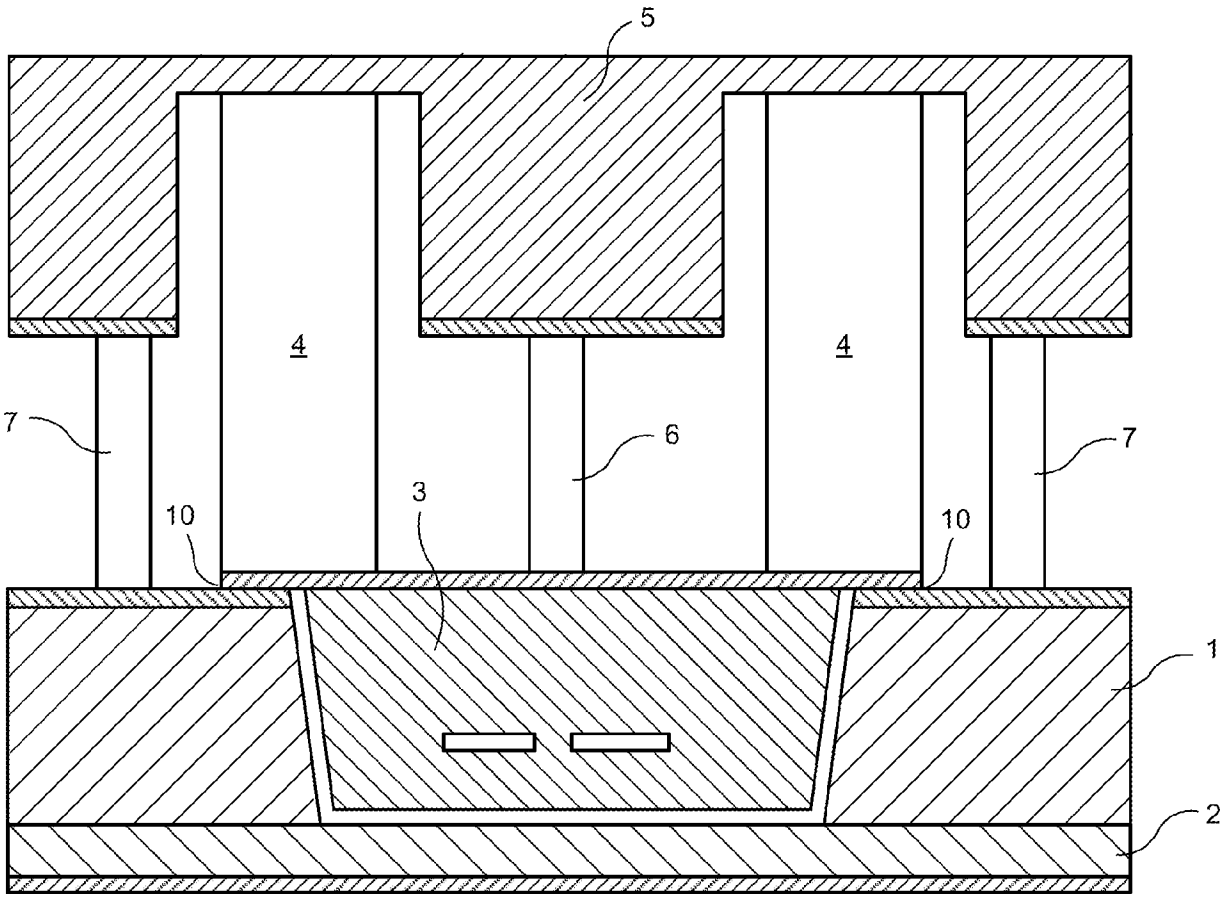
FIG. 1 is a sectional view of the present invention.
Figure 2:
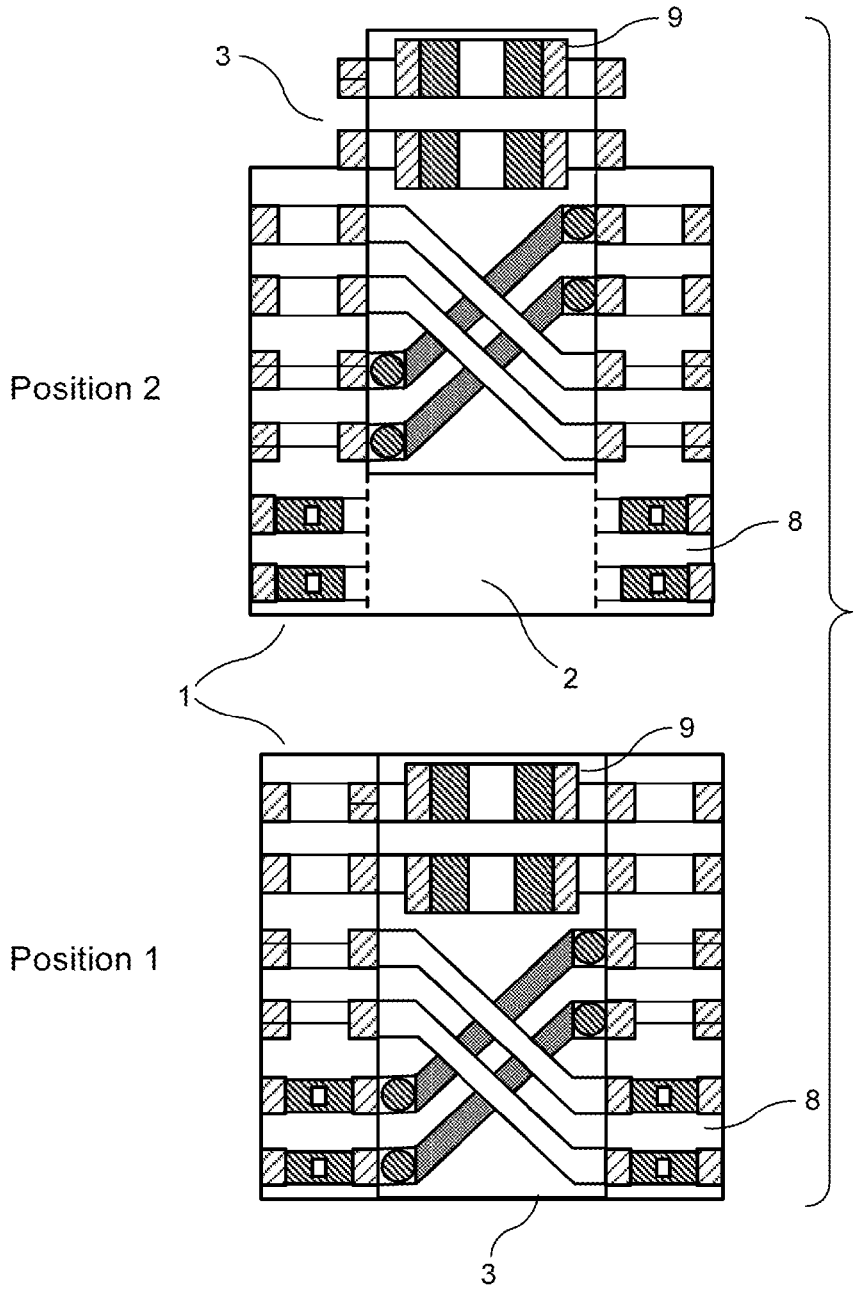
FIG. 2 is a top view with the compression mechanics removed of the present invention.
Figure 3:
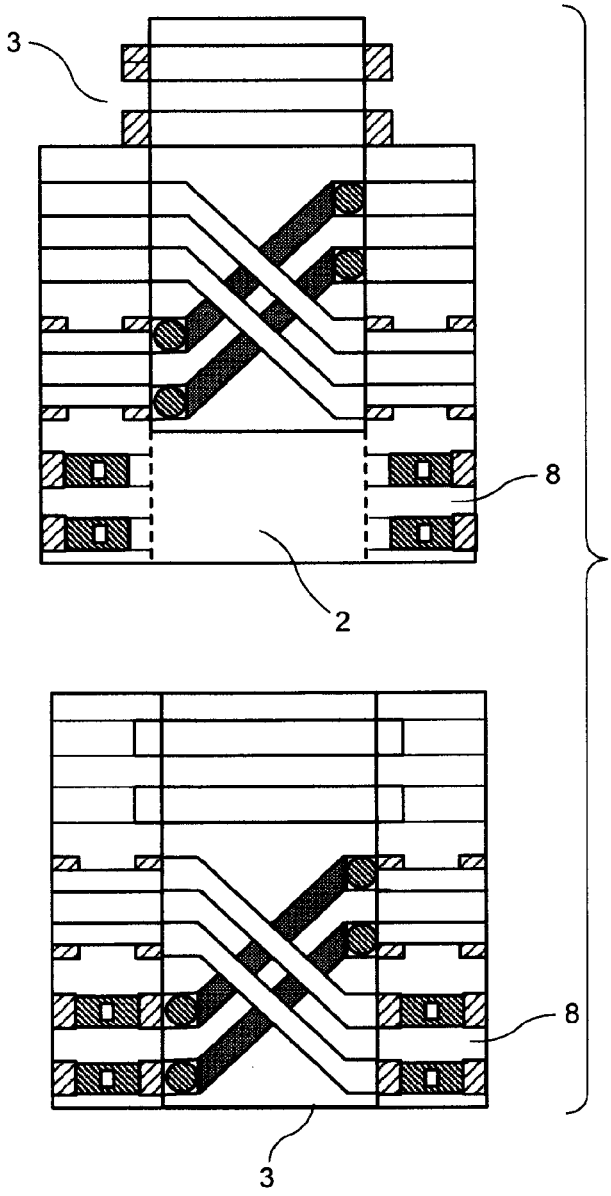
FIG. 3 is a top view of another embodiment of the present invention showing a top down view shown with no components.

Referring now to the drawings of FIGS. 1-3 a shuttle board relay 15 includes stationary 1, 2 and a moving piece 3 that are manufactured from nonconductive metal-clad materials, such as but not limited to printed circuit board materials. The first piece, the stationary piece 1, 2, carrier, provides the external signal path interface. The stationary piece requires a securing substrate 2—both for electrical performance and for mechanical strength and alignment. The substrate 2 may be configured as a separate piece, as in a module affixed via solder, or integrated into a larger unit, such as a printed circuit board. The substrate for the carrier is preferably thermal-chemically bonded to the carrier and used for alignment and strength. As driven by application, the stationary piece 1, 2 may or may not have components 8 mounted on it 1, 2 and therefore is amenable to a very high degree of customization. The carrier and the stationary piece 1, 2 are preferably micro-machined for the shuttle board 3.

Figure 4:
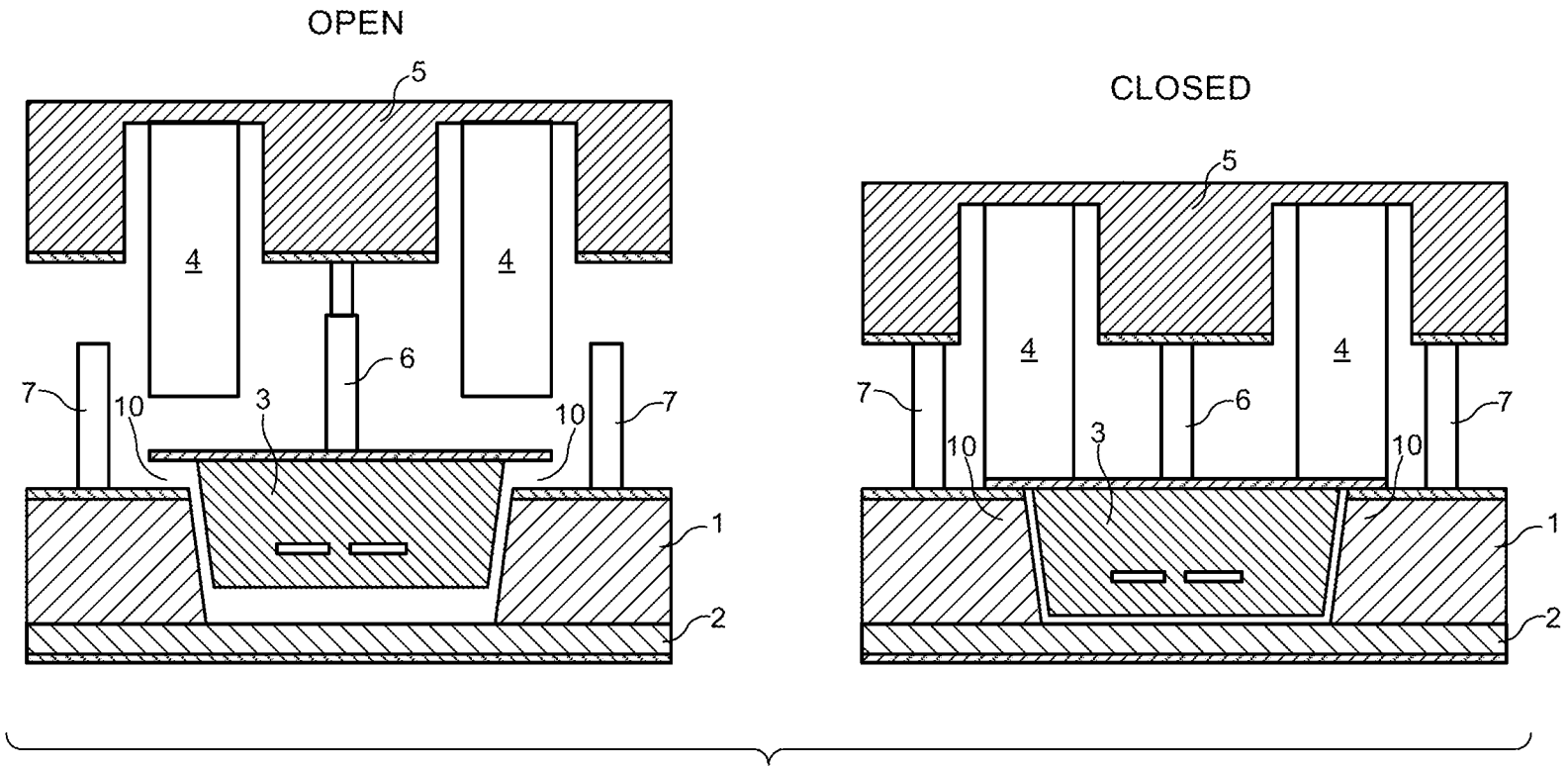
FIG. 4 is a sectional view, showing Z-axis movement of the present invention.
Figure 5:
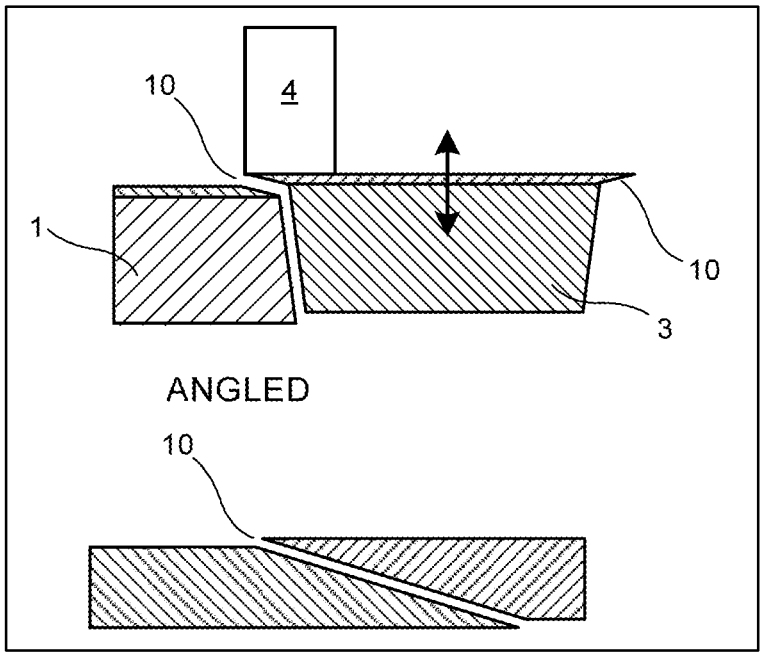
FIG. 5 illustrates the angled co-planar interface of the contactors of the present invention.
Figure 6:
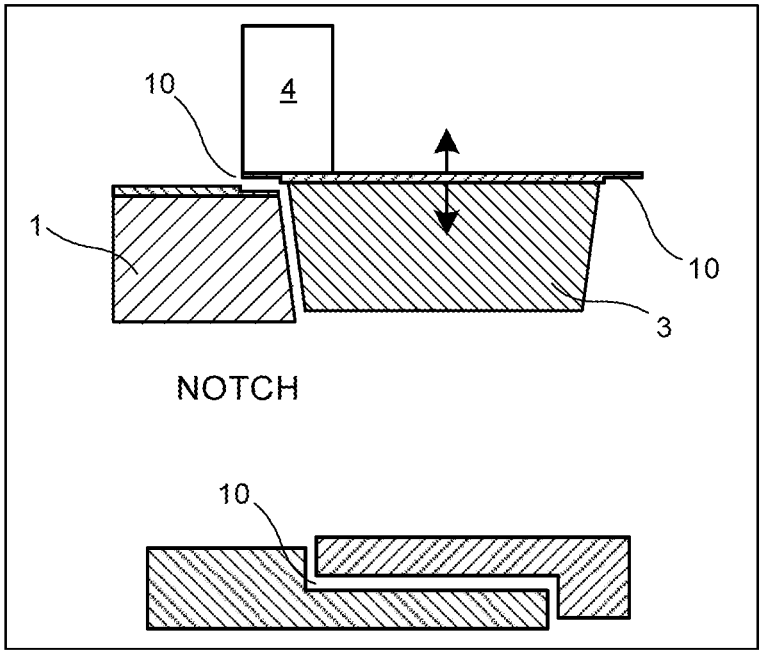
FIG. 6 illustrates notched co-planar interface of the contactors of the present invention.
Figure 7:
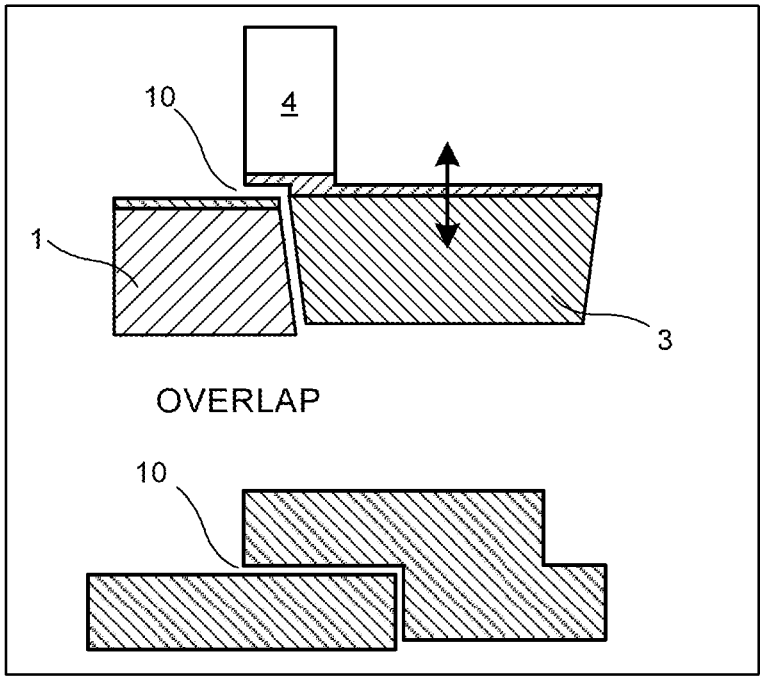
FIG. 7 illustrates overlapped interface (co-planar compromise) of the present invention.
Figure 8:
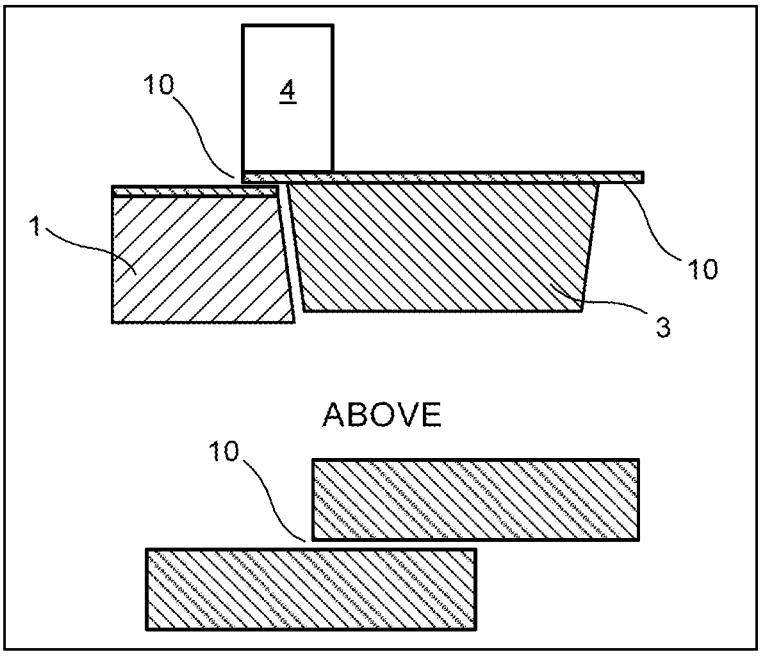
FIG. 8 illustrates an above interface (co-planar compromise) of the present invention.

As shown in FIGS. 2, 3 and 4 of the drawings the stationary piece 2 provides alignment pads to the moving piece, the shuttle board 3. The shuttle board 3 may move in multiple possible directions, although linear, curvature, or rotary directions best support common signal routing methods. In operation the shuttle board is in position 1 (FIG. 2). The shuttle board 3 may have layers and routing within it. Position achieves a specific electrical path from one set of connections on the carrier 2 to another. A mechanical actuator lifts the shuttle board 3 in the Z direction 6 (see FIG. 4) and then moves or rotates it in a planar direction (e.g. Y direction), aligning it with a different set of stationary pads on the carrier 2. It is then lowered/compressed again in the Z direction to predetermined location set by a hard step guide 7. Thus a Position 2 has been achieved (FIG. 3). Reversal of this procedure returns the shuttle board to Position 1. The nature of the carrier shuttle board 3 combination is that the number of positions is only limited by the size of the shuttle board 3 and carrier 2. As driven by application, the shuttle board 3 may or may not have components mounted on it 9 and therefore allows a very high degree of customization. The shuttle 3 changes electrical paths by sliding or rotating in a planar fashion to a different set of contactors, and the sliding is specifically and accurately controlled by one of several different control mechanisms, including, but not limited to, electromagnetic, acoustic, piezoelectric, or pneumatic operation.

As shown in FIGS. 5-8, the shuttle board 3 and carder 2 combination can be manufactured to extremely small dimensions. This, along with the planar signal flow 10, results in very high fidelity performance at very high frequencies. This disclosure covers multiple different methods of interconnect contact. "Overlapped" and "above" contacts are inherently easier to manufacture and offer a lower cost option with some performance degradation. "Notch" and "angled" contacts maintain a planar flow. This improves performance but increase manufacturing cost and difficulties.

FIGS. 1 and 4 illustrate that when the shuttle board or shuttle board relay 3 is compressed downward, the contact region of the signal trace must be cantilevered out over the carrier pad (contact region of the signal trace). Due to very thin width of the metal, the metal will quickly fatigue without some support. A compressible elastomer column 4 provides this support. The elastomer must be guided via a compression guide/hard stop 5 to prevent lateral movement. The compression guide will be electrically close to the signal path and therefore will necessarily couple to it. For high repeatability and to mitigate influences from the outside world, the compression guide is metal plated and usually affixed to a ground reference. The hard stop guide 7 provides electrical continuity to the metal plate covering the hard stop. The hard stops prevent over-compression of the elastomer columns and provide electrical continuity to the metal plate on the compression guide.

Over time, the contactor pads of the shuttle board 3 will wear. For this reason the shuttle board is replaceable and may be done so without conventional desoldering methods. The nonconductive elastomer contactor compression column is used to press the shuttle board's 3 contact pad into the contact pad of the carrier 2 and provides for dimensional stability to the pads, as well as for providing a compressive force. This helps to extend the life of the pads. A slip joint permits the compression force of the elastomer column to be relieved prior to lifting the shuttle board carrier.

The configuration of the shuttle preferably includes two immediate designs that support the most common spacings:

a. 0.65 mm supports 8-10 mil H for microstrips (e.g. Qualcomm);

b. 0.5 mm support 5-7 mil H for microstrips (e.g. Intel, LSI),

The shuttle board relay can preferably be constructed as an independent module affixed to as printed circuit board via solder or other attaches mechanisms. The relay can also be built directly into the surface of a larger printed circuit board so as to provide for better RF performance benefits. The relay can be embedded into a large printed circuit board so that the embedded design has a greater RF performance benefits due to the elimination of vias. Also data port connections can be placed on the same shuttle in order to provide said relay with a tremendous economy of scale. For example, a 4 lane shuttle (that is, 4 differential Tx, Rx+components) requires 10% less board real estate than one GRF303 relay. This is literally a 90% real estate reduction. Even compared to MEMS technologies, the shuttle board relay of the present invention is smaller and holds the promise of better performance.

The contactor for the shuttle board relay of the present invention can have direct pressure applied via an elastomer spring column to help extend life, as a positive pressure will engage the contact unto it completely oxidizes and no metal is left. The relay can operate as a latching relay so as to have less power dissipation and noise benefits.

The operational mechanisms of the present invention are considered secondary to the planar flow properties of this disclosure. The movement of the shuttle hoard may be executed with any one of a variety of miniature mechanisms from piezoelectric and acoustic motors to electromagnetic operations. For n-position shuttle boards, a piezoelectric motor is preferred.

While certain embodiments have been shown and described, it is distinctly understood that the invention is not limited thereto but may be otherwise embodied within the scope of the appended claims.

What is claimed:

1. A tuned shuttle board relay, comprising:

a switchable interconnect and routing mechanism, connected to a fixed set of conductive contactors arranged for an interface with to a sliding shuttle, said shuttle being aligned to a fixed portion of said mechanism, said shuttle being adaptable to change electrical paths and including a first set of electrical connectors connected at one end to an upper portion of a first side of said shuttle and connected at another end to a lower portion of a second side of said shuttle and a second set of said electrical connectors connected at one end to an upper side of said second side of said shuttle and connected at another end to a lower end of a second side of said shuttle so that said first set of electrical connectors lay on top of said second set of set said second set of said electrical connectors at a point of where said first set of electrical connectors crosses over said second set of electrical connectors thereby providing said shuttle has a multi layered routing interconnect arrangement, said shuttle by moving freely about in its entirety within said mechanism by freely sliding, circulating or rotating about in a planar fashion within said mechanism to a different set of contactors; a motion control mechanism for controlling said sliding of said shuttle.

2. The relay according to claim 1 wherein said switchable interconnect and routing mechanism is manufactured from non-conductive material clad with metal for electrical routing.

3. The relay according to claim 1 wherein said shuttle is adaptable to slide or rotate in any one of a rotary, curvature, or linear motion or pattern.

4. The relay according to claim 1 wherein said contactor arrangements include coplanar, notched, overlapped, or above.

5. The relay according to claim 1 wherein said shuttle board relay has a highly planar flow of current, thereby providing for a minimal disruption of the high frequency path and giving the shuttle board relay its high performance.

6. The relay according to claim 1 wherein said shuttle is manufactured from non-conductive material clad with metal for fully customizable electrical routing with mating contactors.

7. The relay according to claim 1 wherein said sliding of said shuttle includes electromagnetic, acoustic, piezoelectric, or pneumatic operation.

8. The relay according to claim 1 wherein said relay is a multiple position relay wherein each contactor connect up to 10 or 12 different positions.

9. The relay according to claim 1 wherein the relay in a fully customizable shuttle, including the mounting of passive and active electrical components on said shuttle.

10. The relay according to claim 1 wherein said shuttle can be replaced without desoldering the relay so that it has a replaceable contactor within the relay thereby dramatically reducing field support and maintenance costs.

11. The relay according to claim 1 wherein said shuttle is configured to common pitches and required spacing for serial lanes.

12. The relay according to claim 1 wherein said configuration of said shuttle includes two immediate designs that support the most common spacings:

a. 0.65 mm supports 8-10 mil H for microstrips b. 0.5 mm support 5-7 mil H for microstrips.

13. The relay according to claim 1 wherein said relay is constructed as an independent module —affixed to a printed circuit board via solder or other attach mechanisms.

14. The relay according to claim 1 wherein said relay is built directly into the surface of a larger printed circuit board thereby providing for better RF performance benefits.

15. The relay according to claim 1 wherein said relay is built to be embedded into a large printed circuit board so that said embedded design has a greater RF performance benefits due to the elimination of vias.

16. The relay according to claim 1 further comprising data port connections that are placed on said same shuttle thereby providing said relay with a tremendous economy of scale.

17. The relay according to claim 1 wherein said contactor has direct pressure applied via an elastomer spring column so as to help extend life, as a positive pressure will engage said contact until it completely oxidizes and no metal is left.

18. The relay according to claim 1 wherein said relay operates as a latching relay so as to have less power dissipation and noise benefits.

19. The shuttle board relay according to claim 1 where said first set of electrical connectors and said second set of electrical connectors are each two connectors.

20. A tuned shuttle board relay, comprising:

a switchable interconnect and routing mechanism, connected to a fixed set of two or more conductive contactors arranged for an interface with to a sliding shuttle, said shuttle being aligned to a fixed portion of said mechanism, said shuttle being adaptable to change electrical paths by sliding or moving in a non-rotating motion in a planar fashion moving freely about in its entirety within said mechanism to a different set of two or more contactors; a motion control mechanism for controlling said sliding or moving of said shuttle wherein said relay is a multiple position relay wherein each contactor can connect up to 10 or 12 different positions.

21. The relay according to claim 20 wherein said switchable interconnect and routing mechanism is manufactured from non-conductive material clad with metal for electrical routing.

22. The relay according to claim 20 wherein said shuttle is adaptable to slide or rotate in any one of a rotary, curvature, or linear motion or pattern.

23. The relay according to claim 20 wherein said contactor arrangements include coplanar, notched, overlapped, or above.

24. The relay according to claim 20 wherein said shuttle board has a highly planar flow of current, thereby providing for minimal for a minimal disruption of the high frequency path and giving the shuttle board relay its high performance.

25. The relay according to claim 20 wherein said shuttle is manufactured from non-conductive material clad with metal for fully customizable electrical routing with mating contactors.

26. The relay according to claim 20 wherein said sliding of said shuttle includes electromagnetic, acoustic, piezoelectric, or pneumatic operation.

27. The relay according to claim 20 wherein the relay in a fully customizable shuttle, including the mounting of passive and active electrical components on said shuttle.

28. The relay according to claim 20 wherein said shuttle can be replaced without desoldering the relay so that it has a replaceable contactor within the relay thereby dramatically reducing field support and maintenance costs.

29. The relay according to claim 20 wherein said shuttle is configured to common pitches and required spacing for serial lanes.

30. The relay according to claim 20 wherein said configuration of said shuttle includes two immediate designs that support the most common spacings:

a. 0.65 mm supports 8-10 mil H for microstrips b. 0.5 mm support 5-7 mil H for microstrips.

31. The relay according to claim 20 wherein said relay is constructed as an independent module—affixed to a printed circuit board via solder or other attach mechanisms.

32. The relay according to claim 20 wherein said relay is built directly into the surface of a larger printed circuit board thereby providing for better RF performance benefits.

33. The relay according to claim 20 wherein said relay is built to be embedded into a large printed circuit board so that said embedded design has a greater RF performance benefits due to the elimination of vias.

34. The relay according to claim 20 further comprising data port connections that are placed on said same shuttle thereby providing said relay with a tremendous economy of scale.

35. The relay according to claim 20 wherein said contactor has direct pressure applied via an elastomer spring column so as to help extend life, as a positive pressure will engage said contact until it completely oxidizes and no metal is left.

36. The relay according to claim 20 wherein said relay operates as a latching relay so as to have less power dissipation and noise benefits.

37. The shuttle board relay according to claim 20 where said first set of electrical connectors and said second set of electrical connectors are each two connectors.

* * * * *